US008397695B2

(12) United States Patent
Glugla et al.

(10) Patent No.: US 8,397,695 B2
(45) **Date of Patent: *Mar. 19, 2013**

(54) IGNITION ENERGY MANAGEMENT WITH ION CURRENT FEEDBACK TO CORRECT SPARK PLUG FOULING

(75) Inventors: Chris Paul Glugla, Macomb, MI (US); Daniel Lawrence Meyer, Dearborn, MI (US); Michael John Cullen, Northville, MI (US); Garlan J. Huberts, Milford, MI (US); Michael Damian Czekala, Canton, MI (US); Ben Allen Strayer, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/397,863

(22) Filed: Feb. 16, 2012

(65) Prior Publication Data

US 2012/0150415 A1 Jun. 14, 2012

Related U.S. Application Data

(63) Continuation of application No. 12/201,033, filed on Aug. 29, 2008, now Pat. No. 8,132,556.

(51) Int. Cl.
*F02P 5/00* (2006.01)

(52) U.S. Cl. ..... 123/406.11; 123/406.23; 123/406.28; 123/406.44

(58) Field of Classification Search ..... 123/406.11–406.15, 406.23, 406.26, 123/406.28, 406.44–406.49
See application file for complete search history.

(56) References Cited

U.S. PATENT DOCUMENTS

| | | | | |
|---|---|---|---|---|
| 4,535,738 | A * | 8/1985 | Ma | 123/406.12 |
| 5,247,919 | A | 9/1993 | Akaki et al. | |
| 5,425,339 | A | 6/1995 | Fukui | |
| 6,155,241 | A | 12/2000 | Hohner et al. | |
| 7,063,079 | B2 | 6/2006 | Huberts et al. | |
| 7,302,932 | B2 | 12/2007 | Shelby et al. | |
| 8,132,556 | B2 * | 3/2012 | Glugla et al. | 123/406.11 |
| 2004/0084021 | A1 | 5/2004 | Zhu et al. | |
| 2004/0084036 | A1 | 5/2004 | Porter et al. | |
| 2004/0085068 | A1 | 5/2004 | Zhu et al. | |
| 2007/0079817 | A1 | 4/2007 | VanDyne et al. | |
| 2011/0041803 | A1 | 2/2011 | Qu et al. | |

* cited by examiner

*Primary Examiner* — John Kwon
(74) *Attorney, Agent, or Firm* — Julia Voutyras; Brooks Kushman P.C.

(57) ABSTRACT

A system and method for operating an engine having ionization signal sensing include detecting plug fouling and controlling the engine using progressively more aggressive control strategies if the fouling condition persists. A first control strategy may be used when the number of engine starts or running time are below corresponding thresholds and a second strategy otherwise. The first strategy may employ progressively more aggressive control procedures to eliminate spark plug deposits that may include repetitive sparking, exhaust cycle sparking, increasing engine loading, advancing spark timing, increasing air/fuel ratio, and increasing idle speed, for example. The second strategy may include similar corrective actions employed in a different order and/or to a lesser degree in an attempt to eliminate plug fouling without any noticeable change in engine operation or performance as perceived by the vehicle operator. The control strategies may be applied to individual cylinders, cylinder banks, or all cylinders.

20 Claims, 6 Drawing Sheets

IGNITION ENERGY MANAGEMENT WITH ION CURRENT FEEDBACK TO CORRECT SPARK PLUG FOULING

CROSS-REFERENCE TO RELATED APPLICATIONS

This application is a division of U.S. application Ser. No. 12/201,033 filed Aug. 29, 2008, now U.S. Pat. No. 8,132,556, the disclosure of which is incorporated in its entirety by reference herein.

TECHNICAL FIELD

The present disclosure relates to systems and methods for managing ignition energy for a spark-ignited internal combustion engine using ion current feedback to reduce spark plug deposit formation.

BACKGROUND

Vehicles are often driven very short distances with the engine running for short periods of time as the vehicles are moved to various temporary storage locations during vehicle assembly. Vehicles may be stored inside or outside for various periods of time before they are loaded on rail cars for transportation to dealerships for delivery to customers. These short engine start and restart cycles under various ambient conditions may lead to formation of carbon and other deposits on one or more spark plugs that could ultimately result in plug fouling and undesirable engine performance. One strategy used to prevent plug fouling associated with short run times at the assembly plant employs an alternate engine calibration with a lean air/fuel ratio, advanced spark timing, and elevated engine idle speed to develop more heat in the combustion chambers and eliminate any spark plug deposits. The alternate calibration affects all cylinders on every start. While this strategy generally reduces or prevents formation of spark plug deposits, the lean air/fuel ratio of the alternate calibration may result in engine stalling, particularly for cold starts, and the higher engine idle speed may be objectionable to some customers. As such, the alternate calibration is employed only for a limited number of engine starts and/or a maximum mileage driven in a single trip so that it is no longer active by the time the vehicle is delivered to a customer. The engine/vehicle controller then uses the regular production calibration and the alternate calibration is never accessed again. However, some customers may have operate the vehicle under similar conditions with short drive cycles that facilitate spark plug deposit formation and could benefit from a similar control strategy to reduce or eliminate plug fouling.

To improve control of the combustion process, ionization current sensing (or ion sense) uses a bias voltage applied across a sensor positioned within the combustion chamber to generate a current signal indicative of the combustion quality and timing. The ion current signal may be used to provide early detection of plug fouling with various corrective actions, as described in U.S. Pat. No. 7,302,932, for example. Depending on the particular engine technology and detected condition, the ion current signal may be used to adjust ignition timing, valve timing, fueling, and/or airflow, for example, to better manage the combustion process.

SUMMARY

A system and method for operating a multiple cylinder internal combustion engine having an ionization current sensor include monitoring ionization current to detect a plug fouling condition and controlling the engine using a first strategy to remove spark plug deposits if the number of engine starts or running time are below corresponding thresholds and a second strategy otherwise. The first strategy may employ progressively more aggressive or noticeable corrective actions to eliminate spark plug deposits that may include repetitive sparking, exhaust cycle sparking, advancing spark timing, increasing air/fuel ratio, and increasing idle speed, for example, and may be applied to individual cylinders, cylinder banks, or all cylinders. The second strategy may include similar corrective actions employed in a different order and/or to a lesser degree in an attempt to correct the plug fouling condition without any noticeable change in engine operation or performance as perceived by the vehicle operator.

In one embodiment a multiple cylinder internal combustion engine includes at least one ionization sensor positioned within one of the cylinders and in communication with an engine controller to provide an ion sensing current indicative of a plug fouling condition. The controller examines steady-state ionization signal level prior to ignition coil energization and compares it to a threshold. Post combustion ionization level may be used in a similar fashion to detect a plug fouling condition. When plug fouling is detected, the controller modifies at least one of air/fuel ratio, number of spark plug restrikes, ignition timing, valve timing, and fueling using a first set of calibration values if accumulated engine starts are below a corresponding threshold and a second set of calibration values otherwise. The controller may apply the corrective calibration values to control a single cylinder, group of cylinders, or all cylinders depending upon the particular application and implementation. Combinations of one or more of the corrective actions may be employed if the plug fouling condition persists. If the plug fouling condition continues to be detected after a predetermined number of corrective attempts or for a predetermined time, a corresponding error code may be logged and the operator alerted via a check-engine light or similar message or alert.

The present disclosure includes embodiments having various advantages. For example, the systems and methods of the present disclosure provide more aggressive corrective actions to reduce or eliminate plug fouling that may occur at the assembly plant while employing a second corrective action strategy that is less likely to be perceived or objectionable to the customer. The present disclosure uses ion current sensing to detect plug fouling conditions and provide progressively more aggressive corrective actions in an attempt to reduce or eliminate plug fouling both at the assembly plant and during short cycle conditions that may occur with some customers after delivery.

The above advantages and other advantages and features will be readily apparent from the following detailed description of the preferred embodiments when taken in connection with the accompanying drawings.

DETAILED DESCRIPTION

Figure 1:
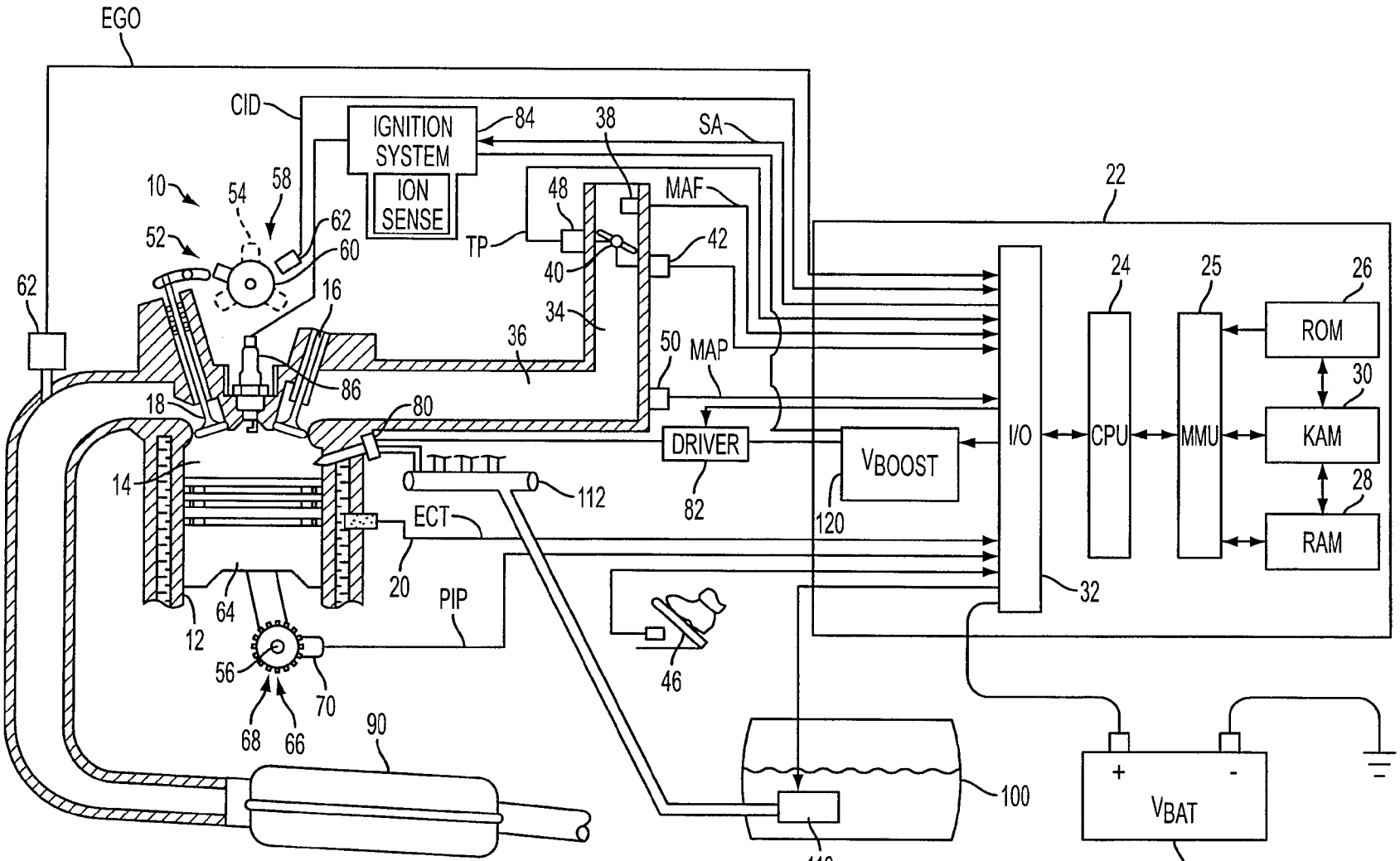
FIG. 1 is a block diagram illustrating operation of a system or method for controlling an internal combustion engine having ionization current monitoring to detect plug fouling according to one embodiment of the present disclosure.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a multi-cylinder, internal combustion engine with direct or in-cylinder injection and an ion sensing system that uses a bias voltage applied across one or more spark plugs to provide an ionization current signal for one or more corresponding cylinders. Those of ordinary skill in the art may recognize similar applications or implementations with other engine/vehicle technologies.

System 10 includes an internal combustion engine having a plurality of cylinders, represented by cylinder 12, with corresponding combustion chambers 14. As one of ordinary skill in the art will appreciate, system 10 includes various sensors and actuators to effect control of the engine. A single sensor or actuator may be provided for the engine, or one or more sensors or actuators may be provided for each cylinder 12, with a representative actuator or sensor illustrated and described. For example, each cylinder 12 may include four actuators that operate intake valves 16 and exhaust valves 18 for each cylinder in a multiple cylinder engine. However, the engine may include only a single engine coolant temperature sensor 20.

Controller 22 has a microprocessor 24, which is part of a central processing unit (CPU), in communication with memory management unit (MMU) 25. MMU 25 controls the movement of data among various computer readable storage media and communicates data to and from CPU 24. The computer readable storage media preferably include volatile and nonvolatile storage in read-only memory (ROM) 26, random-access memory (RAM) 28, and keep-alive memory (KAM) 30, for example. KAM 30 may be used to store various operating variables while CPU 24 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 24 in controlling the engine or vehicle into which the engine is mounted. The computer-readable storage media may also include floppy disks, CD-ROMs, hard disks, and the like depending on the particular application and implementation.

System 10 includes an electrical system powered at least in part by a battery 116 providing a nominal voltage, $V_{BAT}$, which is typically either 12V or 24V, to power controller 22. Power for various engine/vehicle accessories may be supplemented by an alternator/generator during engine operation as well known in the art. A high-voltage power supply 120 generates a boosted nominal voltage, $V_{BOOST}$, relative to the nominal battery voltage and may be in the range of 85V-100V, for example, depending upon the particular application and implementation. In the illustrated embodiment, power supply 120 is used to power both fuel injectors 80 and an ionization sensor, such as spark plug 86. Other embodiments may include dedicated power supplies associated with various systems or modules.

CPU 24 communicates with various sensors and actuators via an input/output (I/O) interface 32. Interface 32 may be implemented as a single integrated interface that provides various raw data or signal conditioning, processing, and/or conversion, short-circuit protection, and the like. Alternatively, one or more dedicated hardware or firmware chips may be used to condition and process particular signals before being supplied to CPU 24. Examples of items that are actuated under control by CPU 24, through I/O interface 32, are fuel injection timing, fuel injection rate, fuel injection duration, throttle valve position, spark plug ignition timing, ionization current sensing and conditioning, and others. Sensors communicating input through I/O interface 32 may indicate piston position, engine rotational speed, vehicle speed, coolant temperature, intake manifold pressure, accelerator pedal position, throttle valve position, air temperature, exhaust temperature, exhaust air to fuel ratio, exhaust constituent concentration, and air flow, for example. Some controller architectures do not contain an MMU 25. If no MMU 25 is employed, CPU 24 manages data and connects directly to ROM 26, RAM 28, and KAM 30. Of course, the present invention could utilize more than one CPU 24 to provide engine control and controller 22 may contain multiple ROM 26, RAM 28, and KAM 30 coupled to MMU 25 or CPU 24 depending upon the particular application.

In operation, air passes through intake 34 and is distributed to the plurality of cylinders via an intake manifold, indicated generally by reference numeral 36. System 10 preferably includes a mass airflow sensor 38 that provides a corresponding signal (MAF) to controller 22 indicative of the mass airflow. A throttle valve 40 may be used to modulate the airflow through intake 34. Throttle valve 40 is preferably electronically controlled by an appropriate actuator 42 based on a corresponding throttle position signal generated by controller 22. The throttle position signal may be generated in response to a corresponding engine output or demanded torque indicated by an operator via accelerator pedal 46. A throttle position sensor 48 provides a feedback signal (TP) to controller 22 indicative of the actual position of throttle valve 40 to implement closed loop control of throttle valve 40.

A manifold absolute pressure sensor 50 is used to provide a signal (MAP) indicative of the manifold pressure to controller 22. Air passing through intake manifold 36 enters combustion chamber 14 through appropriate control of one or more intake valves 16. Intake valves 16 and exhaust valves 18 may be controlled using a conventional camshaft arrangement, indicated generally by reference numeral 52. Camshaft arrangement 52 includes a camshaft 54 that completes one revolution per combustion or engine cycle, which requires two revolutions of crankshaft 56 for a four-stroke engine, such that camshaft 54 rotates at half the speed of crankshaft 56. Rotation of camshaft 54 (or controller 22 in a variable cam timing or camless engine application) controls one or more exhaust valves 18 to exhaust the combusted air/fuel mixture through an exhaust manifold. A cylinder identification sensor 58 provides a signal (CID) once each revolution of the camshaft or equivalently once each combustion cycle from which the rotational position of the camshaft can be determined. Cylinder identification sensor 58 includes a sensor wheel 60 that rotates with camshaft 54 and includes a single protrusion or tooth whose rotation is detected by a Hall effect or variable reluctance sensor 62. Cylinder identification sensor 58 may be used to identify with certainty the position of a designated piston 64 within cylinder 12 for use in determining fueling or ignition timing, for example.

Additional rotational position information for controlling the engine may be provided by a crankshaft position sensor 66 that includes a toothed wheel 68 and an associated sensor 70. In one embodiment, toothed wheel 68 includes thirty-five teeth equally spaced at ten-degree (10°) intervals with a single twenty-degree gap or space referred to as a missing tooth. In combination with cylinder identification sensor 58, the missing tooth of crankshaft position sensor 66 may be used to generate a signal (PIP) used by controller 22 for fuel injection and ignition timing. Crankshaft position sensor 66 may also be used to determine engine rotational speed and to identify cylinder combustion events based on an absolute, relative, or differential engine rotation speed where desired.

An exhaust gas oxygen sensor 62 provides a signal (EGO) to controller 22 indicative of whether the exhaust gasses are lean or rich of stoichiometry. Depending upon the particular application, sensor 62 may provide a two-state signal corresponding to a rich or lean condition, or alternatively a signal that is proportional to the stoichiometry of the exhaust feedgas. This signal may be used to adjust the air/fuel ratio, or control the operating mode of one or more cylinders, for example. The exhaust gas is passed through the exhaust manifold and one or more emission control or treatment devices 90 before being exhausted to atmosphere.

A fuel delivery system includes a fuel tank 100 with a fuel pump 110 for supplying fuel to a common fuel rail 112 that supplies injectors 80 with pressurized fuel. In some direct-injection applications, a camshaft-driven high-pressure fuel pump (not shown) may be used in combination with a low-pressure fuel pump 110 to provide a desired fuel pressure within fuel rail 112. Fuel pressure may be controlled within a predetermined operating range by a corresponding signal from controller 22. In the representative embodiment illustrated in FIG. 1, fuel injector 80 is side-mounted on the intake side of combustion chamber 14, typically between intake valves 16, and injects fuel directly into combustion chamber 14 in response to a command signal from controller 22 processed by driver 82. Of course, the present disclosure may also be applied to applications having fuel injector 80 centrally mounted through the top or roof of cylinder 14.

Fuel injector driver 82 may include various circuitry and/or electronics to selectively supply power from high-voltage power supply 120 to actuate a solenoid associated with fuel injector 80 and may be associated with an individual fuel injector 80 or multiple fuel injectors, depending on the particular application and implementation. Although illustrated and described with respect to a direct-injection application where fuel injectors often require high-voltage actuation, those of ordinary skill in the art will recognize that the teachings of the present disclosure may also be applied to applications that use port injection or combination strategies with multiple injectors per cylinder and/or multiple fuel injections per cycle.

In the embodiment of FIG. 1, fuel injector 80 injects a quantity of fuel directly into combustion chamber 14 in one or more injection events for a single engine cycle based on the current operating mode in response to a signal (fpw) generated by controller 22 and processed and powered by driver 82. At the appropriate time during the combustion cycle, controller 22 generates a signal (SA) processed by ignition system or module 84 to control at least one spark plug 86 and initiate combustion within chamber 14, and to subsequently apply a high-voltage bias across spark plug 86 to enable ionization sensing as described herein. Depending upon the particular application, the high-voltage bias may be applied across the spark gap or between the center electrode of spark plug 86 and the cylinder wall, and may be applied prior to and/or during ignition coil dwell. Ignition system or module 84 may include one or more ignition coils and other circuitry/electronics to actuate associated spark plugs 86, selectively provide multiple sparks per combustion cycle, and provide ion sensing. Charging of the ignition coil may be powered by high-voltage power supply 120 or by battery voltage depending on the particular application and implementation. However, use of the boosted voltage provided by high-voltage power supply 120 may provide various advantages, such as reducing ignition coil charge time and dwell time, which generally allows greater ignition timing flexibility and/or a longer ionization sensing period.

In one embodiment, each spark plug 86 includes a dedicated coil and associated electronics to provide repetitive striking or sparking and ion sensing. Alternatively, a single ignition module 84 may be associated with multiple spark plugs 86 with ionization sensing provided using a power pair arrangement to reduce the number of necessary control lines. The representative embodiment illustrated includes a single spark plug 86 in each cylinder that functions to ignite the fuel mixture and then acts as the ion sensor as described herein. However, the present disclosure may be used in applications that use dual spark plugs with one or both providing mixture ignition and/or ion sensing.

Controller 22 includes code implemented by software and/or hardware to control system 10. In one embodiment, controller 22 monitors ionization current to detect fouling of at least one spark plug 86 and controls engine 10 using progressively more aggressive control procedures in response to detection of a spark plug fouling condition. Stated differently, controller 22 may employ various corrective actions or control procedures to reduce or eliminate plug fouling that progress from procedures that are less likely to be noticed by the vehicle operator, but may not be as effective in removing spark plug deposits, to procedures that are more aggressive or more likely to result in temporary engine or vehicle performance degradation that may be noticeable or objectionable to the vehicle operator. Control procedures to remove or prevent spark plug deposits may include repetitive sparking during a single combustion cycle, sparking during an exhaust stroke, increasing engine mechanical and/or electrical load, advancing ignition timing, fuel enleanment or reducing fuel/air ratio, and increasing engine idle speed, for example. The particular order in which the corrective control procedures are employed and/or the number of procedures employed in combination may vary by application or by the particular operating or ambient conditions as described in greater detail herein.

In one embodiment, controller 22 detects plug fouling based on a comparison of ionization current/voltage level to a corresponding threshold prior to energizing the ignition coil (pre-dwell) and/or during ignition coil dwell plug fouling indicated when the ionization current/voltage exceeds a corresponding threshold as illustrated and described in greater detail with reference to FIGS. 3A-3C and FIG. 4. When plug fouling is detected, controller 22 may control engine 10 using a relatively more aggressive first control strategy to remove spark plug deposits if accumulated engine starts or running time is below a corresponding threshold and a second, relatively less aggressive control strategy to remove spark plug deposits otherwise. The first control strategy may include one or more corrective control procedures that are applied to all cylinders with the second control strategy applied only to those cylinders where plug fouling is detected. By selecting a control strategy based on the number of accumulated engine starts or running time, more aggressive control can be employed at the assembly plant to reduce or prevent plug fouling conditions associated with frequent short running cycles prior to delivery of the vehicle to a customer.

Figure 2:
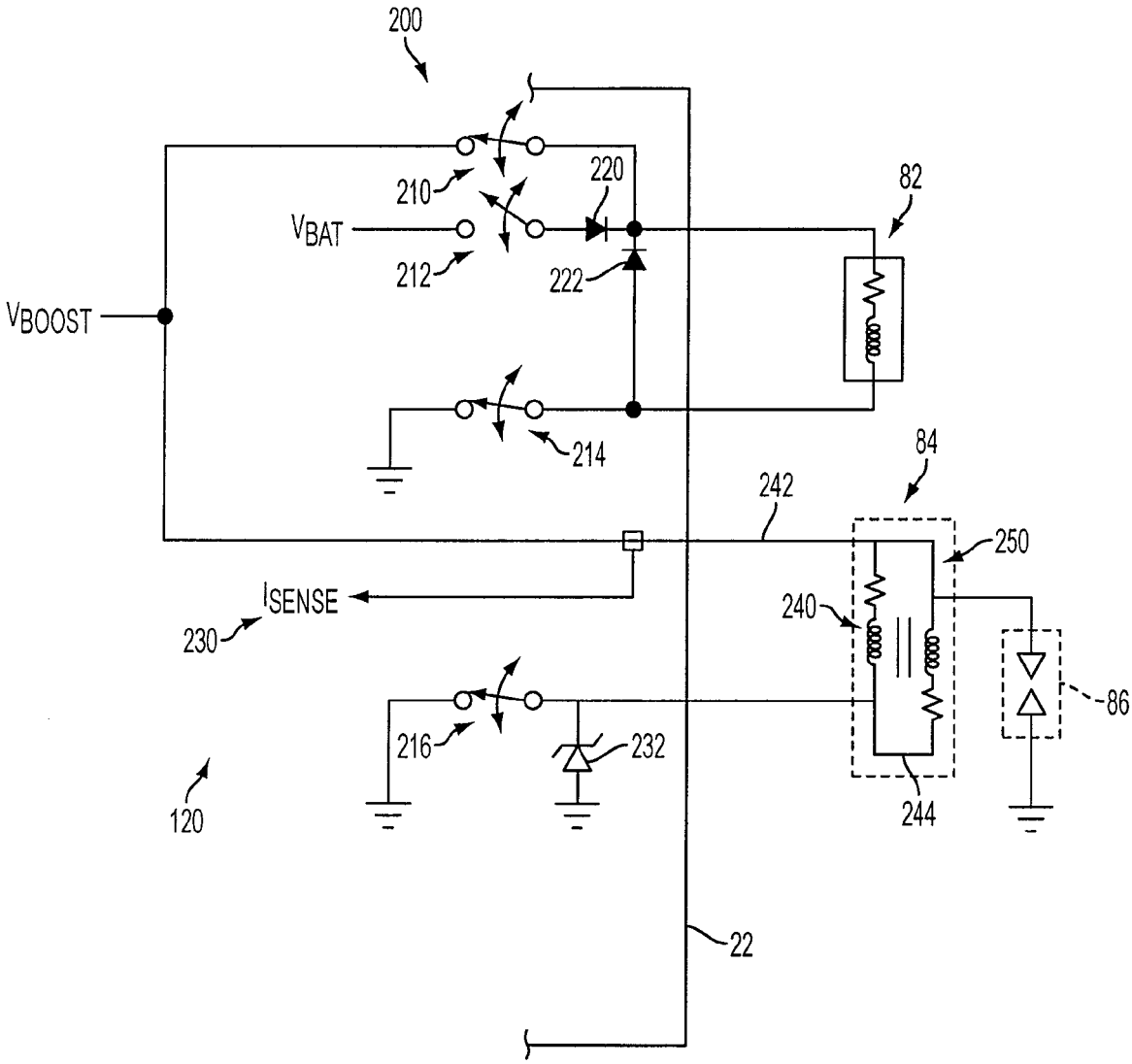
FIG. 2 is a simplified schematic illustrating one embodiment of an engine controller with ion sensing to detect plug fouling according to one embodiment of the present disclosure.

FIG. 2 is a simplified schematic illustrating connections for, and operation of, an integrated high-voltage power supply according to one embodiment of the present disclosure. In this embodiment, power supply 120 is integrated with engine/vehicle controller 22 and includes a plurality of switches 200 for selectively connecting various inputs/outputs in response to the control logic within controller 22 during operation. Switches 200 may be implemented by one or more types of solid-state devices, such as transistors and/or relays, for example. In operation, switch 210 and switch 214 are closed to selectively connect fuel injector solenoid 82 to the high-voltage supply, $V_{BOOST}$. Current is blocked by diodes 220 and 222 and flows through solenoid coil 82 to initiate a fuel injection event. A holding current may subsequently be applied using battery voltage and appropriate actuation of switches 210, 212, and 214 to complete the fuel injection event. Substantially the same voltage from the high-voltage supply 120 may be used to charge ignition coil 84 to generate one or more sparks across the air gap of spark plug 86 during a single combustion cycle, and to apply a bias voltage to induce an ionization current signal, $I_{sense}$, indicative of combustion quality and timing within the corresponding cylinder. As illustrated and described in greater detail with reference to FIGS. 3-4, the ionization current/voltage signal may be monitored prior to ignition coil energization or dwell, during ignition coil dwell, and/or post-combustion to detect a plug fouling condition. As used herein, the ion sensing signal may be referred to as an ionization current or equivalently an ionization voltage, with the ionization voltage produced by passing the ionization current signal through a known resistance.

To charge or energize ignition coil 84, switch 216 is closed connecting one side 244 of primary winding 240 to ground with the other side 242 of primary winding 240 connected to the boost voltage causing current to flow through primary winding 240. Soft turn-on technology may be used to ensure that the spark discharge event does not occur at the initiation of coil charging rather than the at the desired coil turn-off time or times for repetitive sparking, also referred to as multi-striking. When the control logic of controller 22 generates an ignition timing signal, switch 216 is opened to collapse the magnetic field of coil 84 and induce a high voltage (on the order of kilovolts) in secondary winding 250 resulting in a spark discharge across the electrodes of spark plug 86 to initiate combustion within the corresponding cylinder. For repetitive sparking or multi-strike, coil 240 may be only partially discharged on each strike or spark. After completion of the ignition event, which may include one or more sparks or strikes, the boost voltage is then used as a bias voltage across spark plug 86 with ions generated during combustion of the fuel/air mixture within the cylinder conducting across the air gap of spark plug 86 and generating a small ionization current signal 230 detected by controller 22. A current mirror or similar circuitry may be integrated into ignition module 84 or controller 22 to detect and amplify the ionization current signal and/or convert the signal to a voltage signal.

As illustrated in the embodiment of FIG. 2, the bias voltage for the ionization sensing is provided by the high-voltage power supply 120. However, various other known arrangements are possible to provide a bias voltage for ionization current sensing, such as using a charge capacitor or the ignition coil itself to provide the necessary bias voltage to induce ionization current.

Figure 3A:
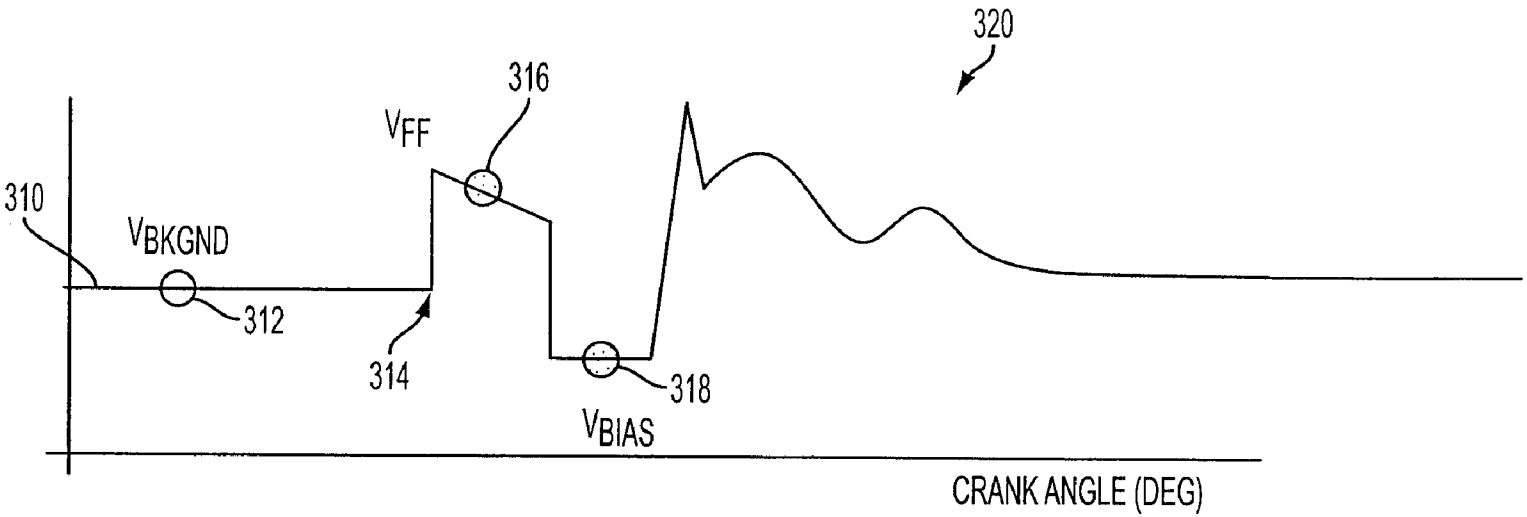
FIGS. 3A-3C provide a graphical illustration of a representative ionization sensing signals used to detect plug fouling and implement corrective control according to one embodiment of the present disclosure.
Figure 3B:
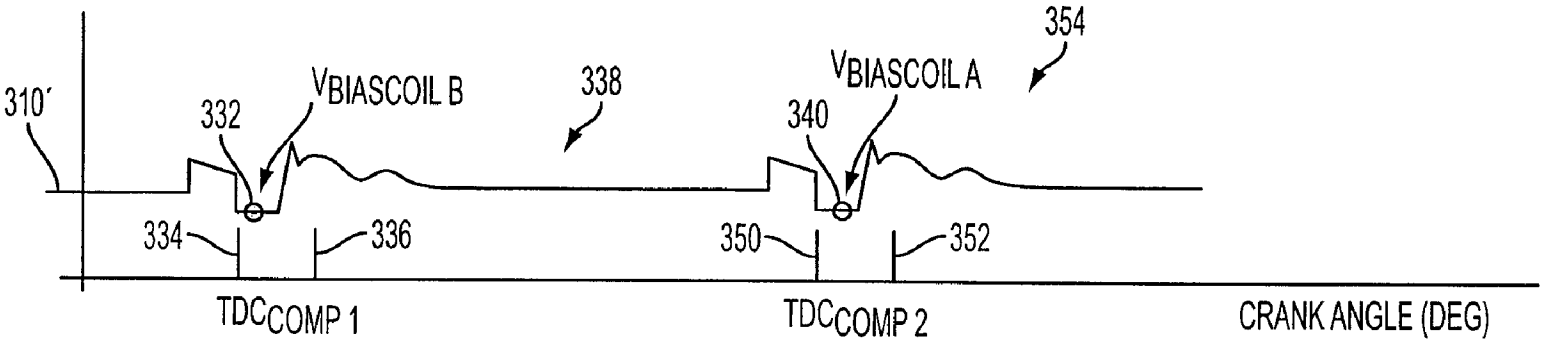
Figure 3C:
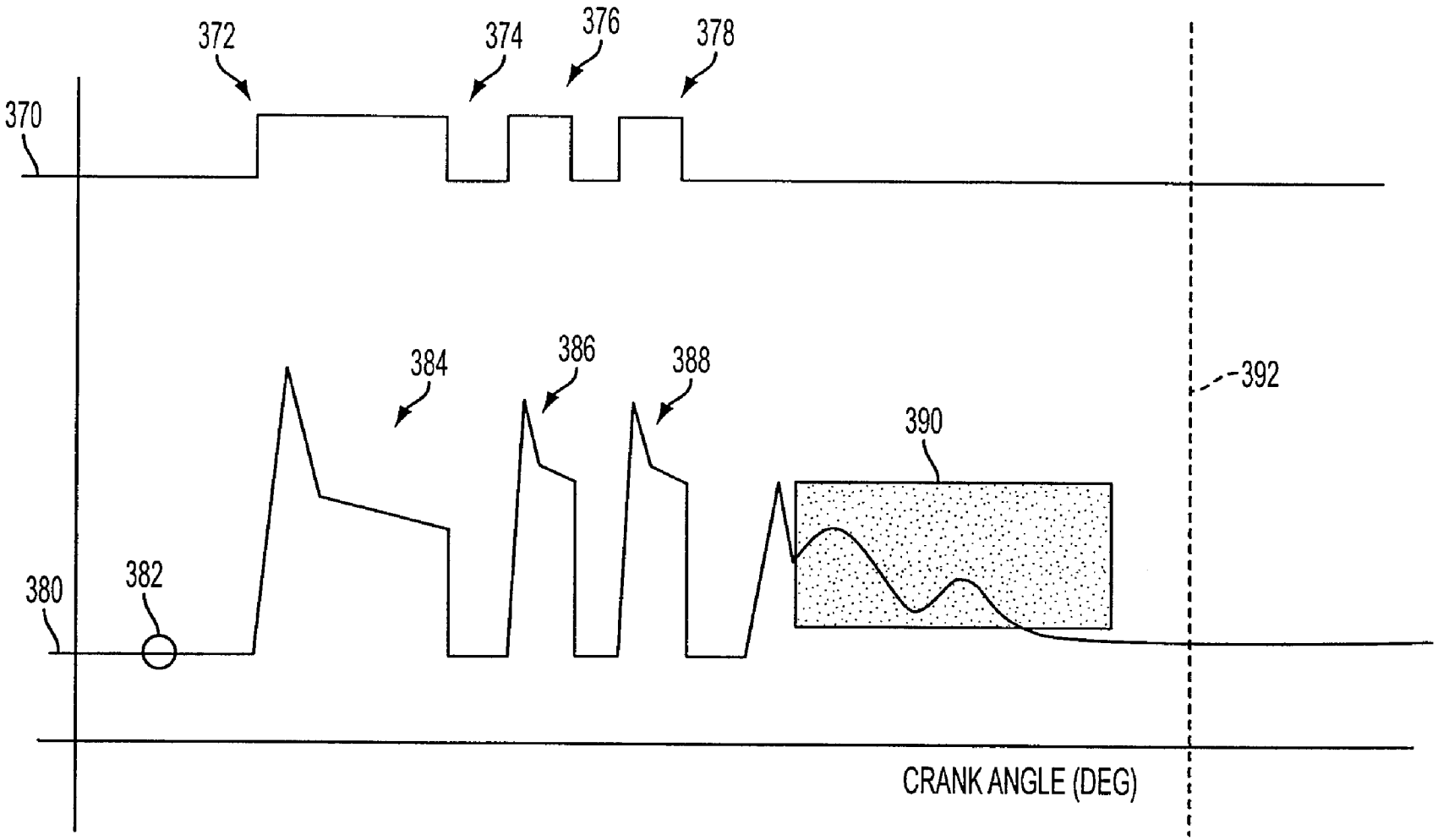

FIGS. 3A-3C provide a graphical representation of an ionization signal and associated control signals associated with operation of a system or method for controlling an engine according to embodiments of the present disclosure. Real-time acquired ion sense signals for each engine cylinder are processed and stored by controller 22. For each combustion event, the information for the most recent engine cylinder firing is processed to identify features such as peak values, signal integral areas, derivative or slope values, statistics (such as maximum, minimum, mean, or variability) based on these values, or crankshaft locations of any of the values or statistics, generally referred to as measurements. Additionally, depending on coil design, ion energy can be monitored before or during the ignition coil dwell period, where spark plug shunting resistance can be measured during sampling periods 312, 316, respectively, as described below. Lowering of shunt resistance and a corresponding increase in the floor or steady-state ionization signal level is indicative of deposit formation or fouling of the spark plug.

Sufficient numbers of samples, or cylinder event series of samples, are used to ensure statistical significance for all measurements. These measurements may be collected in one group or in a one-in, one-out, sliding window form depending on the particular application and implementation. Once the sample size is appropriate for the statistical significance required, the data elements representing one or more series of measurements are processed to produce a regression equation. This regression equation is then available to estimate either historical or instantaneous engine combustion stability. The regression equation is periodically updated for the desired level of accuracy. When the engine operating time has been sufficient to allow for valid combustion stability measurements by means other that ion sense, these values can be used to calibrate the accuracy of the ion derived combustion stability estimate.

The regression equations, combustion stability estimates, and corrections based upon these estimates can all be adaptively stored for subsequent use, with resets at appropriate vehicle events (refueling, altitude, etc.) if desired. This technology also enables selection of a wide range of spark plug heat ranges during engine development and may reduce otherwise necessary design compromises for best performance under a wide range of operating and ambient conditions. The selection of a spark plug for a specific engine application is a function of many variables, where the ability of the spark plug and cylinder head subsystem to dissipate heat is a main factor. Without ignition energy management consistent with the present disclosure, manufacturers select a nominal heat range spark plug, with the nominal heat range plug being a compromise with respect to cold fouling robustness, or to pre-ignition avoidance. Implementation of ignition energy management with progressively more aggressive control procedures according to the present disclosure may effectively widen the heat range of the nominal spark plug. Heat ranges could be chosen one or two ranges hotter or colder relative to what would have been chosen as "nominal" for the engine design. In the case of a colder than "nominal" range, the igniting energy management strategy of FIGS. 3A-3C would be employed to heat up the plug and remove deposits with additional arcing of sparks.

FIG. 3A illustrates a representative ionization sensing signal that may be used to detect plug fouling according to the present disclosure. Ionization signal 310 is monitored prior to ignition coil energization or dwell during sampling period 312. A plug fouling condition is indicated where the background voltage of the ionization signal, represented by $V_{bkgnd}$ exceeds a corresponding threshold. When deposits form on the spark plug, the conductive carbon lowers the shunt resistance allowing a leakage current to flow through the spark plug when a bias voltage is applied to the spark plug. Those of ordinary skill in the art will recognize that the leakage current may be similar to an ionization current but results from a different physical phenomenon, i.e. leakage current is conducted by the spark plug deposits rather than ions associated with combustion.

As also shown in FIG. 3A, the ionization signal 310 increases at coil energization, represented by reference numeral 314, and ramps down during coil charging during sampling period 316. This feedforward voltage level, represented by $V_{ff}$ is proportional to the ignition coil turn ratio and charging voltage. Once a plug fouling condition is detected, various corrective control procedures may be applied as described herein. During the post-combustion period 320, the ionization signal may be analyzed to provide an indication of combustion quality and timing.

FIG. 3B illustrates a representative ionization signal in a multiplexed system to reduce the number of necessary control lines while providing ionization sensing for all cylinders. In this embodiment, cylinders A and B form a power pair having a common control/sensing wire or line. Cylinders A and B represent cylinders that are non-sequential in the firing order such that the power stroke or combustion within cylinder A occurs during a different phase of the combustion cycle relative to cylinder B, such as during the exhaust or intake stroke of cylinder B. In this arrangement, the background voltage $V_{bkgnd}$ represents the combination or addition of voltage from both cylinders A and B. As such, the background voltage can not be used to identify a particular fouled cylinder. However, the signal produced by applying the bias voltage, as represented by $V_{Bias}$ may be used to indicate fouling when it exceeds a corresponding threshold. Signal 310' is monitored to determine the voltage level for cylinder coil B as previously described with respect to FIG. 3A during sampling period 332 after initiation of a spark at 334. The piston of cylinder A reaches top dead center (TDC) at 336 and signal 310' is analyzed during period 338 to provide an indication of actual combustion timing and performance. A spark in cylinder B is initiated at 350 with signal 310' monitored during sampling period 340 corresponding to the bias voltage of coil A to determine fouling of the spark plug in cylinder A. The piston in cylinder B reaches TDC at 352 and signal 310' is analyzed during period 354 to provide an indication of actual combustion timing and performance in cylinder B. Thus, as shown in FIG. 3B, the bias voltage level on coil B is determined and compared to a corresponding threshold to detect plug fouling in cylinder B while coil A is firing. Likewise, the bias voltage level on coil A is compared to a corresponding threshold to detect plug fouling in cylinder A while coil B is firing.

When plug fouling is detected, progressively more aggressive control procedures are implemented to reduce or remove deposits on the spark plug. FIG. 3C illustrates repetitive sparking or multi-strike spark control to reduce or eliminate plug deposits. Multi-strike is one possible corrective control procedure that may be employed when a spark plug fouling condition is detected, and is generally less aggressive relative to other control procedures as illustrated and described herein. In the illustration of FIG. 3C, signal 370 represents an ignition system control signal from controller 22, while signal 380 represents a feedback signal used to detect plug fouling and for ionization signal sensing. Plug fouling may be detected as previously described by comparing signal 380 during a sampling period 382 to a corresponding threshold. If signal 380 exceeds the corresponding threshold, a plug fouling condition is indicated and progressively more aggressive corrective control procedures are implemented that may begin with multiple sparking or multi-strike control. One will also recognize that multiple thresholds of signal 380 can be used to trigger different levels of progressively aggressive corrective control procedures.

FIG. 3C generally represents a simplified multi-strike or multiple spark control procedure. Once the plug fouling condition is indicated at 382, the ignition control signal 370 is asserted at 372 to energize the ignition coil with the feedback signal rising in response at 384 as previously described. When control signal 370 is asserted at 372, the primary winding of the ignition coil is energized for a dwell period until a first spark is initiated at 374. Two subsequent coil charging and re-strike dwell periods precede spark initiations at 376 and 378 in an attempt to remove any deposits on the spark plug. Feedback signal 380 responds in a similar manner for the subsequent coil charging and spark initiations at 386 and 388 with combustion occurring and the ionization signal monitored during sampling period 390. As shown in FIG. 3C, the corrective control procedure includes three sparks within the same cylinder during a single combustion cycle, generally indicated by dashed line 392. The process may be repeated for multiple combustion cycles each time a plug fouling condition is detected if desired. The number of sparks or multiple strikes in any particular combustion cycle may vary depending upon the particular application and implementation and/or depending upon the condition of the spark plug deposits as indicated by signal 382 compared to a threshold, and or current operating and ambient conditions, such as engine speed and load, for example.

Figure 4:
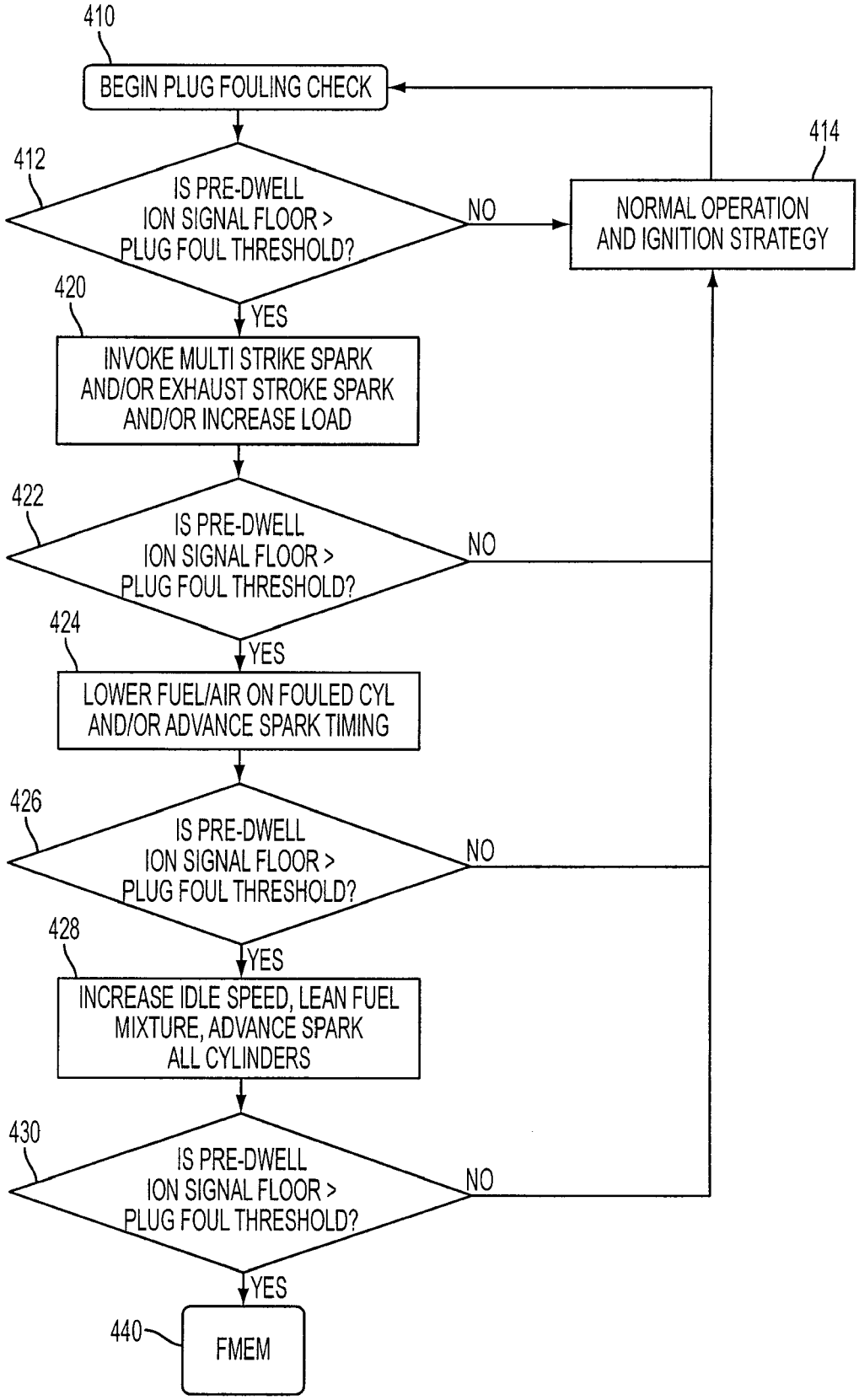
FIG. 4 is a flow chart illustrating operation of a system or method for controlling an internal combustion engine to detect and correct plug fouling using ionization sensing and ignition energy management according to embodiments of the present disclosure.
Figure 5:
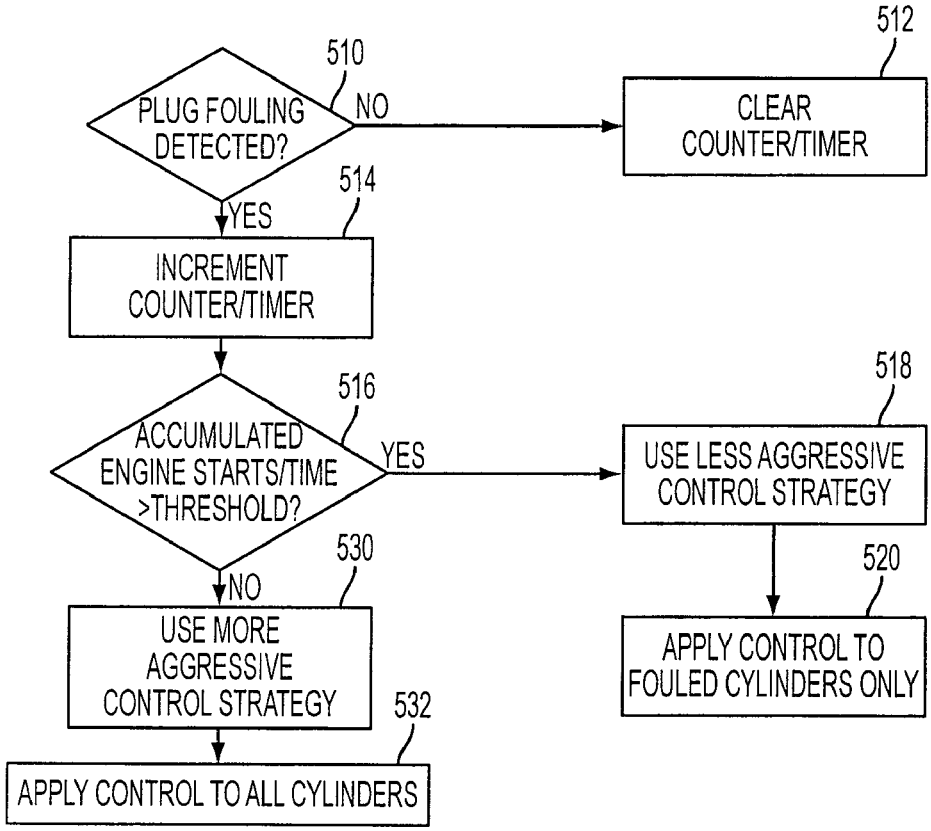
FIG. 5 is a flow chart providing an alternative illustration for operation of a system or method for controlling an engine to detect and correct plug fouling according to embodiments of the present disclosure.

The diagrams of FIGS. 4 and 5 provide representative control strategies for an internal combustion engine having progressively more aggressive control procedures to reduce or eliminate spark plug following according to the present disclosure. The control strategies and/or logic illustrated in FIGS. 4 and 5 represent are generally stored as code implemented by software and/or hardware in controller 22. Code may be processed using any of a number of known strategies such as event-driven, interrupt-driven, multi-tasking, multi-threading, and the like. As such, various steps or functions illustrated may be performed in the sequence illustrated, in parallel, or in some cases omitted. Although not explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. Preferably, the control logic or code represented by the simplified flow charts of FIGS. 4 and 5 is implemented primarily in software with instructions executed by a microprocessor-based vehicle, engine, and/or powertrain controller, such as controller 22 (FIG. 1). Of course, the control logic may be implemented in software, hardware, or a combination of software and hardware in one or more controllers depending upon the particular application. When implemented in software, the control logic is preferably provided in one or more computer-readable storage media having stored data representing code or instructions executed by a computer to control the engine. The computer-readable storage media may include one or more of a number of known physical devices which utilize electric, magnetic, optical, and/or hybrid storage to keep executable instructions and associated calibration information, operating variables, and the like.

Block 410 of FIG. 4 begins a spark plug fouling check, which proceeds to block 412 to determine whether the steady-state ionization signal level prior to energization of the ignition coil, also referred to as the pre-dwell phase, exceeds a corresponding threshold. The pre-dwell feedback signal provides a measurement of the shunt resistance, which will generally lower as conductive carbon-containing deposits form on the spark plug. If the ionization signal or shunt resistance does not indicate fouling, normal operation and control strategies are performed as represented by block 414. Otherwise, a first corrective control procedure, which may include lesser aggressive or the least aggressive control procedure, is selected as represented by the multi-strike spark and/or exhaust stroke spark and/or increasing engine mechanical or electrical load procedures of block 420. The multi-strike or repetitive spark control illustrated and described with reference to FIG. 3C may be performed during the intake/power stroke of the combustion cycle and/or during the exhaust stroke of the combustion cycle to remove deposits that cause plug fouling. After one or more combustion cycles of using a less aggressive control procedure, a second control procedure may be used in place of or in combination with a previous procedure to provide a more aggressive corrective action if the fouling condition persists. One skilled in the art will also recognize that decision block 412 could be used to compare ion signal levels to various thresholding levels, and employ more aggressive corrective actions such as described in procedures contained within block 428, for example.

As described in greater detail with reference to FIG. 6, the aggressiveness of a control strategy may vary depending upon a number of factors that may include but are not limited to the level of shunting resistance, the number of cylinders the control procedure is applied to, the parameter range or authority of control, and the combination of control procedures. For example, repetitive or multi-strike spark may be used only on fouled cylinders, followed by fuel enleanment and spark advance on fouled cylinders with the parameter range limited to control NVH, followed by fuel enleanment and spark advance on all cylinders, etc.

Block 422 of FIG. 4 determines whether the plug fouling condition remains after the first corrective control procedure performed by block 420, similar to the threshold test of block 412. If the fouling condition has been corrected, normal operation and ignition strategy is implemented as represented by block 414. If the plug fouling condition remains, a second, more aggressive control procedure is implemented as represented by block 424. In the representative embodiment illustrated, fuel enleanment is performed to lower the fuel/air ratio for only the cylinder where fouling has been detected. Ignition or spark timing may also be advanced relative to MBT for the affected cylinder in place of, or in combination with, lowering the fuel/air ratio. This procedure may also be performed for a single cycle or repeated for a number of combustion cycles before advancing to a more aggressive control procedure if the fouling condition persists as determined by block 426. If the fouling condition has been removed, normal operation and ignition strategy is implemented by block 414.

If the fouling condition persists as determined by block 426, block 428 controls all cylinders using progressively more aggressive control procedures, which may include increasing engine idle speed, fuel enleanment, and/or advancing spark for all cylinders. This procedure or combination of procedures may be performed for a single combustion cycle or multiple cycles before determining if the plug fouling condition persists as represented by block 430. If the condition has been corrected, normal operation and ignition strategy is implemented by block 414. Otherwise, various FMEM actions may be performed as represented by block 440. These may include registering a diagnostic code and alerting the operator by a service indicator light or message in addition to various other control procedures, such as stopping fuel delivery to the affected cylinder, limiting maximum engine speed, etc. depending on the particular application and implementation.

The diagram of FIG. 5 illustrates one embodiment of a system or method for controlling an internal combustion engine having ionization current sensing to reduce or eliminate plug fouling according to the present disclosure. Block 510 determines whether a plug fouling condition exists. This may include monitoring ionization current to detect fouling of at least one spark plug. As previously described, the controller may compare pre-combustion or pre-dwell ionization current level to corresponding thresholds to detect plug fouling. If plug fouling is not detected, a corresponding timer/counter or other indicator is cleared or reset as represented by block 512. When plug fouling is detect at block 510, a corresponding timer, counter, or other indicator is initialized as represented by block 514. Block 516 then determines if the accumulated number of engine starts and/or the accumulated engine running time exceeds a corresponding threshold, which may be selected to indicate a new engine/vehicle during assembly or prior to delivery to a customer. The engine is controlled using a first control strategy to remove spark plug deposits as represented by blocks 530 and 532 if the accumulated engine starts or running time are below the threshold as determined by block 516 and controlled using a second control strategy to remove spark plug deposits otherwise, as represented by blocks 518 and 520.

The first control strategy represented by blocks 530 and 532 is generally a more aggressive control strategy than the second control strategy represented by blocks 518 and 520. As used herein, a more aggressive control strategy is more likely to impact engine/vehicle performance and be noticeable or possibly objectionable to the vehicle operator, but is also more likely to remove the spark plug deposits causing fouling. In contrast, the less aggressive control strategy is less likely to impact engine performance in a manner that is noticeable or objectionable to the operator. As illustrated and described in greater detail with reference to FIG. 6, a less aggressive control strategy may include control procedures that are applied only to cylinders where a fouling condition is detected. Applying the same control procedures to all cylinders may be considered progressively more aggressive as it is generally more likely to impact engine performance in a manner noticeable to the operator. The control is repeated with the counter/timer incremented at block 514 if the fouling condition persists. After a selected number of combustion cycles, which may be a single cycle or multiple cycles, progressively more aggressive control procedures may be employed to correct the fouling condition.

Figure 6:
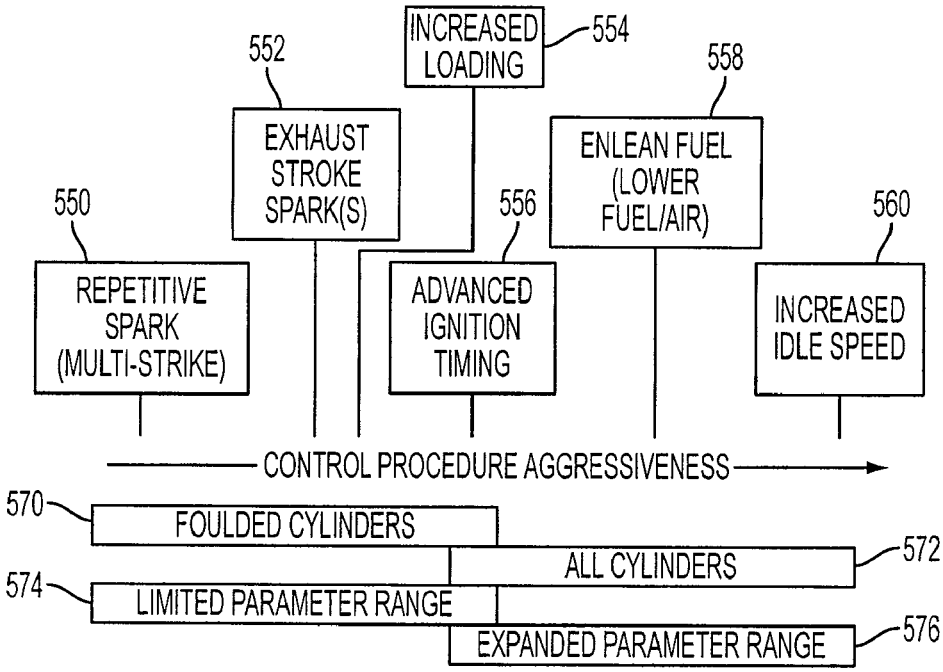
FIG. 6 is a graphical representation of control procedures for a more aggressive or less aggressive control strategy to control an engine when plug fouling is detected according to embodiments of the present disclosure.

FIG. 6 is a graphical representation of various control procedures that may be used to provide progressively more aggressive control of an internal combustion engine while a plug fouling condition exists. Those of ordinary skill in the art will recognize various other control procedures that may be used to correct plug fouling depending upon the particular engine technology and application. The representative procedures are generally illustrated in order of aggressiveness. However, any control procedure may be made more aggressive than another control procedure by applying the selected procedure to multiple cylinders, by using a more aggressive control parameter value, or using in combination with another procedure, for example. As such, the present disclosure is not limited to the representative control procedures illustrated or the order in which the procedures are illustrated and described with respect to representative embodiments.

The representative control procedures include repetitive sparking or multi-strike sparking as represented by block 550 and illustrated and described in greater detail with respect to FIG. 3. Multi-strike sparking 550 may generally be implemented to correct plug fouling without a noticeable change in engine operation and is therefore considered less aggressive. Similarly, sparking during the exhaust stroke rather than the power stroke as represented by block 552 is a less aggressive control procedure and in many cases may be interchanged with, or used in combination with multi-strike sparking without a noticeable change in engine performance. Increased engine loading as represented by block 554 may also be used to correct a fouling condition. Engine loading could be increased by increasing electrical (alternator) load, or in the case of hybrid vehicles by generating more electrical power for the battery. Increased load on the engine generally results in increased airflow while maintaining the same engine speed to increase combustion temperatures and remove deposits.

Other control procedures that may be included in a corrective control strategy are generally more aggressive and may be used alone or in combination include advancing ignition timing relative to MBT as represented by block 556, fuel enleanment as represented by block 558, and increasing idle speed as represented by block 560. Any control procedure applied only to the fouled cylinders as represented by block 570 is generally considered to be less aggressive than the same procedure applied to all cylinders as represented by block 572. Similarly, any control procedure used with a limited parameter range as represented by block 574 is considered to be less aggressive than the same procedure used with an expanded parameter range as represented by block 576. For example, advancing ignition timing within a limited parameter range of 0-3 degrees would be considered less aggressive than advancing ignition timing within an expanded parameter range of 3-10 degrees. Of course, these are general considerations and the actual implementation of what may constitute a less aggressive or more aggressive control strategy is subjectively determined by a particular vehicle operator.

As such, the present disclosure includes embodiments of systems and methods for controlling an engine that provide more aggressive corrective actions to reduce or eliminate plug fouling that may occur at the assembly plant while employing a second corrective action strategy that is less likely to be perceived or objectionable to the customer. Embodiments of the present disclosure use ion current sensing to detect plug fouling conditions and provide progressively more aggressive corrective actions in an attempt to reduce or eliminate plug fouling both at the assembly plant and during short-cycle operating conditions that may occur with some customers after delivery. Use of the least noticeable or least aggressive control procedures required to correct the plug fouling condition may result in improved customer satisfaction.

While the best mode has been described in detail, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed is:

1. A system for operating a multiple cylinder internal combustion engine having at least one spark plug associated with each cylinder, the system comprising:

an ignition module connected to the spark plugs for selectively providing either an ignition voltage across a selected spark plug to initiate combustion or a bias voltage across the selected spark plug to induce an ionization signal; and a controller in communication with the ignition module, the controller monitoring the ionization signal to detect fouling of the at least one spark plug and, if fouling is detected, controlling the engine using a first control strategy to remove spark plug deposits if accumulated engine starts or running time is below a corresponding threshold and a second control strategy to remove spark plug deposits otherwise.

2. The system of claim 1 wherein the first control strategy and second control strategy include controlling the ignition module to repetitively apply ignition voltage across the selected spark plug to generate a series of sparks during a single combustion cycle to remove spark plug deposits.

3. The system of claim 1 wherein the first control strategy is applied to all cylinders and the second control strategy is applied only to cylinders where plug fouling is detected.

4. The system of claim 1 wherein at least the second control strategy includes implementing progressively more aggressive control procedures in response to detection of plug fouling, wherein the control procedures are selected from repetitive sparking, increasing engine load, advancing ignition timing, reducing fuel/air ratio, and increasing idle speed.

5. The system of claim 1 wherein the controller compares pre-combustion ionization signal level to a corresponding threshold to detect plug fouling.

6. The system of claim 5 wherein the controller detects a plug fouling condition when the ionization signal level exceeds the corresponding threshold.

7. The system of claim 1 wherein at least the second strategy includes applying ignition voltage to the selected spark plug during an exhaust stroke of an associated cylinder to generate an exhaust stroke spark.

8. A system for operating an engine, comprising:

an ignition module for selectively providing a bias voltage across a selected spark plug to induce an ionization signal; and a controller configured to detect plug fouling in response to the ionization signal and, if fouling is detected, control the engine using a first strategy to remove deposits if accumulated engine starts or running time is below a corresponding threshold and a second strategy to remove deposits otherwise.

9. The system of claim 8 wherein the first and second strategies include controlling the ignition module to repetitively apply ignition voltage across the selected spark plug to generate a series of sparks during a single combustion cycle to remove spark plug deposits.

10. The system of claim 9 wherein the first strategy is applied to all cylinders and the second strategy is applied only to cylinders where plug fouling is detected.

11. The system of claim 10 wherein at least the second strategy includes implementing progressively more aggressive control procedures in response to detection of plug fouling, wherein the control procedures are selected from repetitive sparking, increasing engine load, advancing ignition timing, reducing fuel/air ratio, and increasing idle speed.

12. The system of claim 8 wherein the controller compares pre-combustion ionization signal level to a corresponding threshold to detect plug fouling.

13. The system of claim 12 wherein the controller detects a plug fouling condition when the ionization signal level exceeds the corresponding threshold.

14. The system of claim 8 wherein at least the second strategy includes applying ignition voltage to the selected spark plug during an exhaust stroke of an associated cylinder to generate an exhaust stroke spark.

15. A computer readable storage medium having stored data representing instructions executable by a microprocessor to control a multiple cylinder internal combustion engine having at least one spark plug per cylinder to detect spark plug fouling, the computer readable storage medium comprising:

code that controls the engine using progressively more aggressive control procedures in response to detection of a spark plug fouling condition, wherein the control procedures progress from a first procedure to at least a second procedure with the first and second procedures selected from repetitive sparking during a single combustion cycle, sparking during an exhaust stroke, increasing engine loading, advancing ignition timing, reducing fuel/air ratio, and increasing engine idle speed.

16. The computer readable storage medium of claim 15 further comprising:

code that controls the engine using a first control strategy to remove spark plug deposits if accumulated engine starts or running time is below a corresponding threshold; and controls the engine using a second control strategy to remove spark plug deposits otherwise.

17. The computer readable storage medium of claim 15 further comprising:

code that controls all cylinders using progressively more aggressive control procedures if accumulated engine starts or running time is below a corresponding threshold; and code that controls only cylinders having a fouled plug condition using progressively more aggressive control procedures if accumulated engine starts or running time exceeds the corresponding threshold.

18. The computer readable storage medium of claim 15 further comprising:

code that first controls only cylinders having a detected plug fouling condition using progressively more aggressive control procedures and subsequently controls all cylinders using progressively more aggressive control procedures if the detected plug fouling condition persists.

19. The computer readable storage medium of claim 15 further comprising:

code that compares ionization signal level to corresponding threshold levels to select more aggressive control procedures based on a degree of plug fouling.

20. The computer readable storage medium of claim 15 further comprising:

code that performs an increasing number of the control procedures in combination as the plug fouling condition persists.

* * * * *